US005927104A

United States Patent [19]

Green

[11] Patent Number: 5,927,104

[45] Date of Patent: Jul. 27, 1999

[54] MODULAR EARRING ASSEMBLY

[76] Inventor: Ruth Green, 1708 Summerwood Dr., Clarkston, Ga. 30021

[21] Appl. No.: 08/950,148

[22] Filed: Oct. 14, 1997

[51] Int. Cl.[6] ..... A44C 7/00

[52] U.S. Cl. ..... 63/13; 24/578; 63/1.16; 63/23; 63/40; 63/41

[58] Field of Search ..... 24/578; 63/1.12, 63/1.13, 1.14, 1.15, 1.16, 13, 21, 23, 29.1, 40, 41; 70/456 R, 459

[56] References Cited

U.S. PATENT DOCUMENTS

| | | | |
|---|---|---|---|
| 358,832 | 3/1887 | Brooks | 63/13 |
| 2,316,225 | 4/1943 | Hoffman et al. | 63/29.1 |
| 3,862,550 | 1/1975 | Sengenberger | 63/29.1 |
| 4,248,071 | 2/1981 | Kussoy | 70/456 R |
| 4,519,220 | 5/1985 | Burrell | 63/23 X |
| 4,866,952 | 9/1989 | Hight et al. | 63/1.14 X |
| 4,974,982 | 12/1990 | Nielson | 401/195 |
| 5,097,679 | 3/1992 | Johnson et al. | 63/23 X |
| 5,505,061 | 4/1996 | Fleury, Jr. et al. | 63/13 X |

FOREIGN PATENT DOCUMENTS

| | | | |
|---|---|---|---|
| 59495 | 6/1913 | Austria | 63/29.1 |

*Primary Examiner*—Brian K. Green
*Assistant Examiner*—Andrea Chop

[57] ABSTRACT

A modular earring assembly comprises a first core module having a top and a bottom, a ring being affixed to the top, and a first base module having a top and a bottom, the top including a cylindrical projection member, the first base module being couplable to the first core module.

4 Claims, 3 Drawing Sheets

MODULAR EARRING ASSEMBLY

BACKGROUND OF THE INVENTION

1. Field of the Invention

The present invention relates to a modular earring assembly and more particularly pertains to replacing modules of the apparatus to enable a user to match to her attire.

2. Description of the Prior Art

The use of earrings is known in the prior art. More specifically, earrings heretofore devised and utilized for the purpose of adorning a user's ear are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,048,310 to Riley discloses a apparatus for changeable earring pendants.

U.S. Pat. No. 4,781,036 to Erickson discloses a pierced-ear earring with changeable decorative earring elements.

U.S. Pat. No. 4,218,894 to Tropea discloses a pierced earring with adjustable ornament.

U.S. Pat. No. 4,753,828 to Francis et al. discloses color changeable earrings.

U.S. Pat. No. 3,630,048 to Masters discloses a earring with vertically adjustable lobe contact member.

U.S. Pat. No. 3,533,247 to Douglas discloses a earring kit with plural changeable pendants.

While these devices fulfill their respective, particular objective and requirements, the aforementioned patents do not describe a modular earring assembly for replacing modules of the apparatus to enable a user to match to her attire.

In this respect, the modular earring assembly according to the present invention substantially departs from the conventional concepts and designs of the prior art, and in doing so provides an apparatus primarily developed for the purpose of Replacing modules of the apparatus to enable a user to match to her attire.

Therefore, it can be appreciated that there exists a continuing need for new and improved modular earring assembly which can be used for replacing modules of the apparatus to enable a user to match to her attire. In this regard, the present invention substantially fulfills this need.

SUMMARY OF THE INVENTION

In the view of the foregoing disadvantages inherent in the known types of earrings now present in the prior art, the present invention provides an improved modular earring assembly. As such, the general purpose of the present invention, which will be described subsequently in greater detail, is to provide a new and improved modular earring assembly and method which has all the advantages of the prior art and none of the disadvantages.

To attain this, the present invention essentially comprises a new and improved modular earring assembly adapted for use in association with a user's ear having an open clip positioned therethrough, the apparatus comprising, in combination: a short core module formed in a generally cylindrical configuration with an axis, a closed top and a bottom, a ring being affixed to the center point of the closed top, the bottom including a bore with a plurality of female screw threads positioned therein; a medium core module formed in a generally cylindrical configuration with an axis, a closed top and a bottom, the medium core module having a length between 75 and 90 percent greater than the length of the short core module, a ring being affixed to the center point of the closed top, the bottom having a bore including a plurality of female screw threads positioned therein; a long core module formed in a generally cylindrical configuration having an axis, a closed top and an open bottom, the long core module having a length between 3.5 and 4 times greater than the length of the short core module, a ring being affixed to the center point of the closed top, the open bottom including a plurality of female screw threads positioned therein; a rounded core module formed in a generally cylindrical configuration having an axis, a closed top, a bottom and a rounded sidewall, the rounded core module having a length approximately equal to the length of the short core module, a ring being affixed to the center point of the closed top, the bottom including a bore with a plurality of female screw threads positioned therein; first and second large base modules, each base module being formed in a generally disc shaped configuration with a top, a flat bottom and a sidewall, the top including a cylindrical projection member including male screw threads positioned therearound, the first base module having a sidewall including a plurality of jewels affixed therearound, each large base module being threadedly couplable to the long core module; a first small base module including a planar circular plate having a top and a bottom, the bottom having a semispherical bore extending therein, a spherical jewel being affixed within the semispherical bore of the plate, a second small base module being formed in a generally cylindrical configuration with a top, a flat bottom and a rounded sidewall, a third small base module being formed in an elongated generally cylindrical configuration with a top, a rounded bottom and a sidewall, the top of each small base module including a cylindrical projection member with male screw threads extending therefrom, each small base module being threadedly couplable to the short, medium and rounded core modules; and an adapter module being formed in a generally cylindrical configuration with bottom, a rounded sidewall and a top including a cylindrical projection member having male screw threads positioned therearound, the bottom including a bore with a plurality of female screw threads positioned therein, in an operative orientation the adapter module threadedly coupling a core module to a base module.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved modular earring assembly which has all the advantages of the prior art and none of the disadvantages.

It is another object of the present invention to provide a new and improved modular earring assembly which may be easily and efficiently manufactured and marketed.

It is a further object of the present invention to provide a new and improved modular earring assembly which is of durable and reliable construction.

An even further object of the present invention is to provide a new and improved modular earring assembly which is susceptible of a low cost of manufacture with regard to both materials and labor, and which accordingly is then susceptible of low prices of sale to the consuming public, thereby making such a Modular earring assembly economically available to the buying public.

Still yet another object of the present invention is to provide a new and improved modular earring assembly which provides in the apparatuses and methods of the prior art some of the advantages thereof, while simultaneously overcoming some of the disadvantages normally associated therewith.

Even still another object of the present invention is to provide a new and improved modular earring assembly for replacing modules of the apparatus to enable a user to match to her attire.

Lastly, it is an object of the present invention to provide a new and improved modular earring assembly comprises a first core module having a top and a bottom, a ring being affixed to the top, the bottom including a bore having coupling means; and a first base module having a top and a bottom, the top including a cylindrical projection member having coupling means, the first base module being couplable to the first core module.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
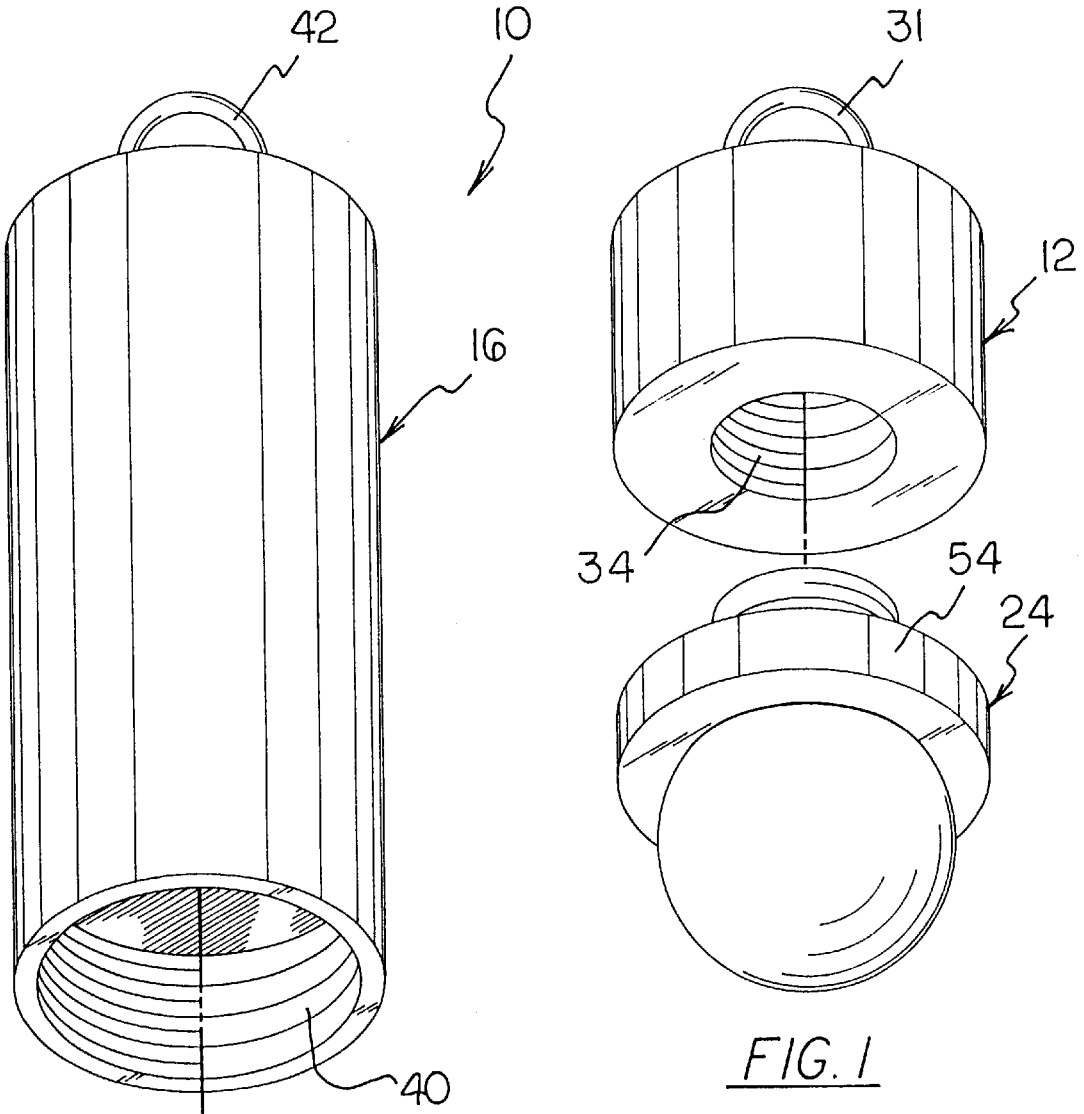
FIG. 1 is a perspective view of the preferred embodiment of the modular earring assembly constructed in accordance with the principles of the present invention.

With reference now to the drawings, and in particular, to FIG. 1 thereof, the preferred embodiment of the new and improved Modular earring assembly embodying the principles and concepts of the present invention and generally designated by the reference number 10 will be described.

Specifically, it will be noted in the various Figures that the device relates to a modular earring assembly 10 enabling a user to match to her attire. In its broadest context, the device consists of four core modules 12, 14, 16, 18, five base modules 20, 22, 24, 26, 28 and an adapter module 30. Such components are individually configured and correlated with respect to each other so as to attain the desired objective.

The modular earring assembly 10 is adapted for use in association with a user's ear. To utilize the apparatus a user positions a conventional open earring clip through her ear and suspends the apparatus from the clip. The apparatus enables a user to mix and match the various components to match her attire, hair style. All of the components can be manufactured in a plurality of different colors. Note FIG. 1.

Figure 5:
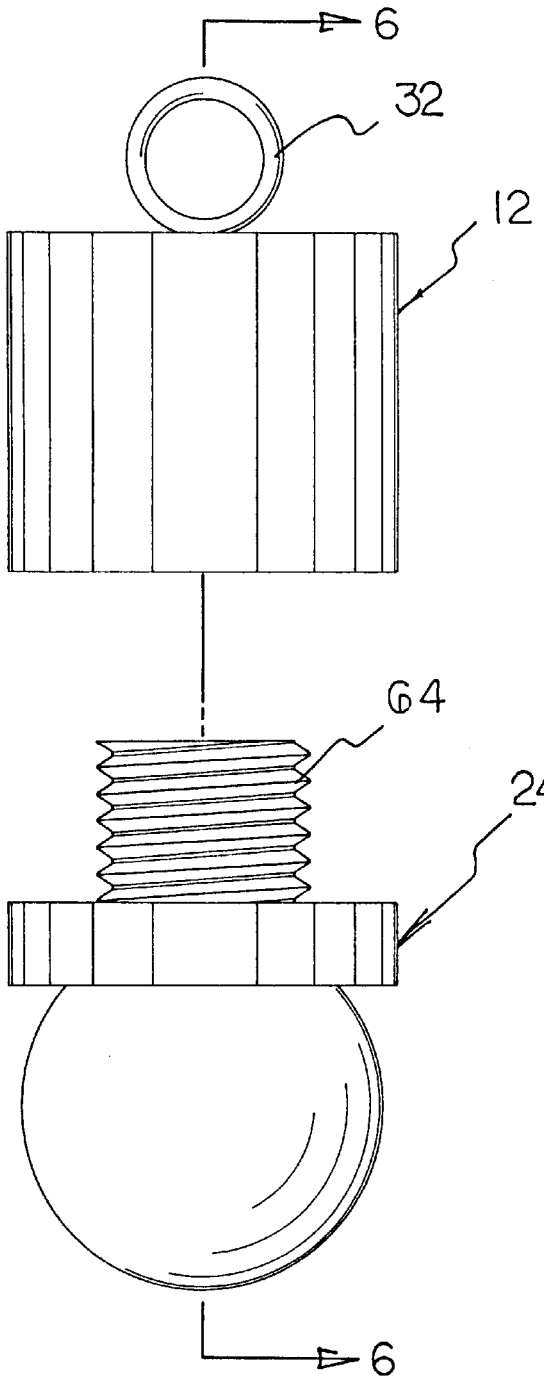
FIG. 5 is a perspective view of the short earring module with a jeweled base.
Figure 6:
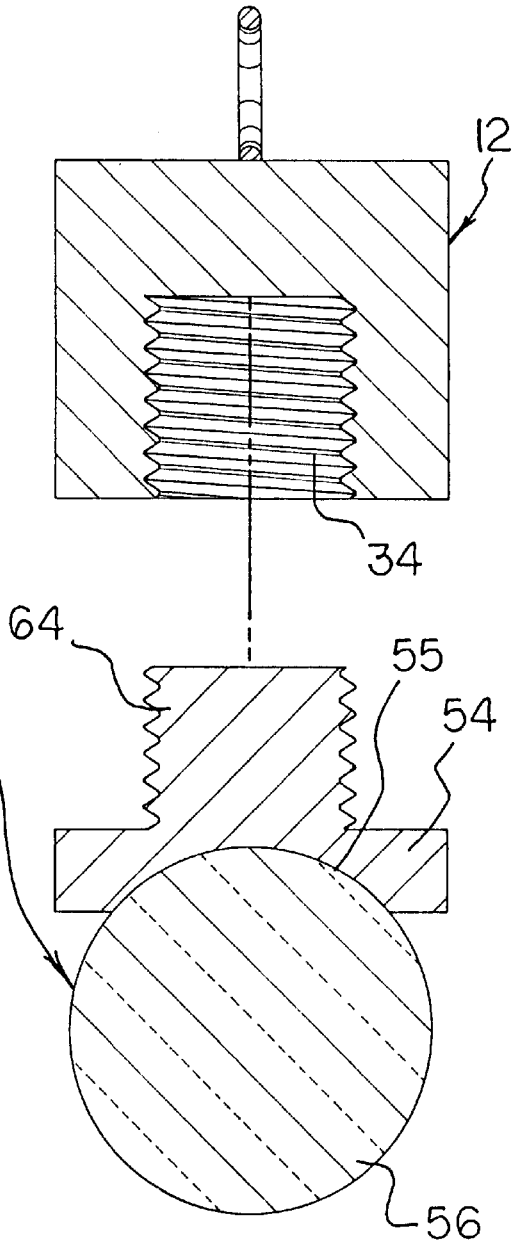
FIG. 6 is a cross sectional view of the apparatus taken along section line 6—6 of FIG. 5.

A short core module 12 is formed in a generally cylindrical configuration with an axis, a closed top and a bottom. A ring 32 is affixed to the center point of the closed top. The bottom of the short core module includes a bore 34 with a plurality of female screw threads. These modules particularly suited for use with conservative wardrobe styles and women with short hair. Note FIGS. 1, 5 and 6.

Figure 4:
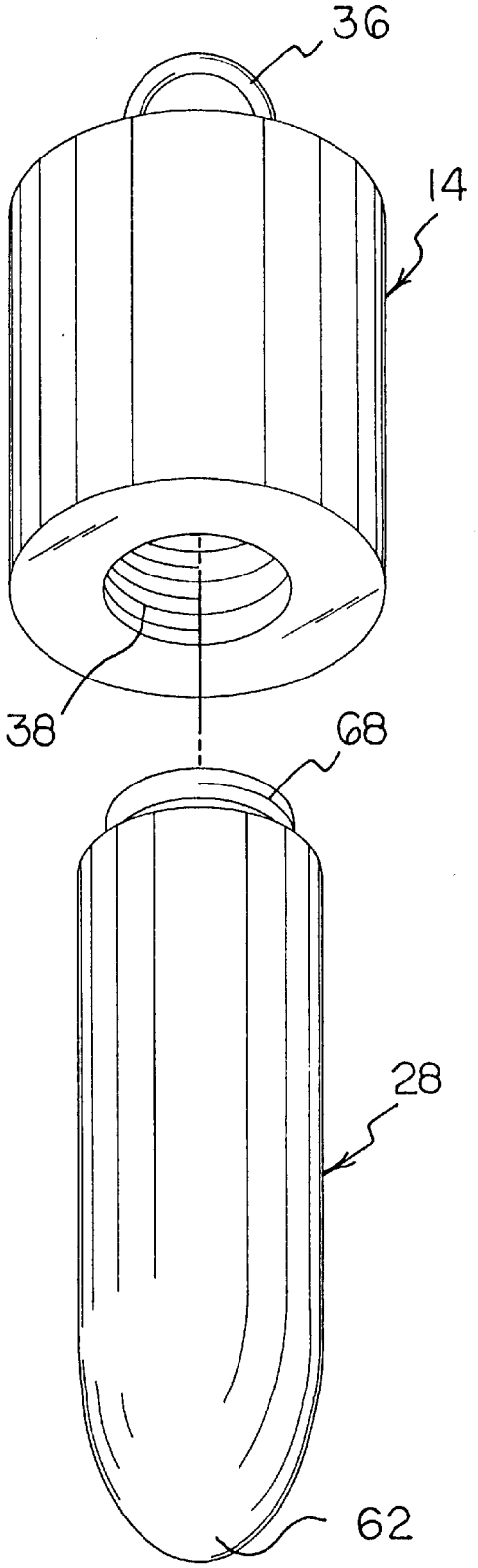
FIG. 4 is a perspective view of the medium earring module with a base.

A medium core module 14 is formed in a generally cylindrical configuration with an axis, a closed top and a bottom. The diameter of the medium core module is essentially the same as the short core module. The diameter of the medium core module is about equal to its height. A ring 36 is affixed to the center point of the closed top. The bottom has a bore 38 including a plurality of female screw threads. Note FIG. 4.

Figure 2:
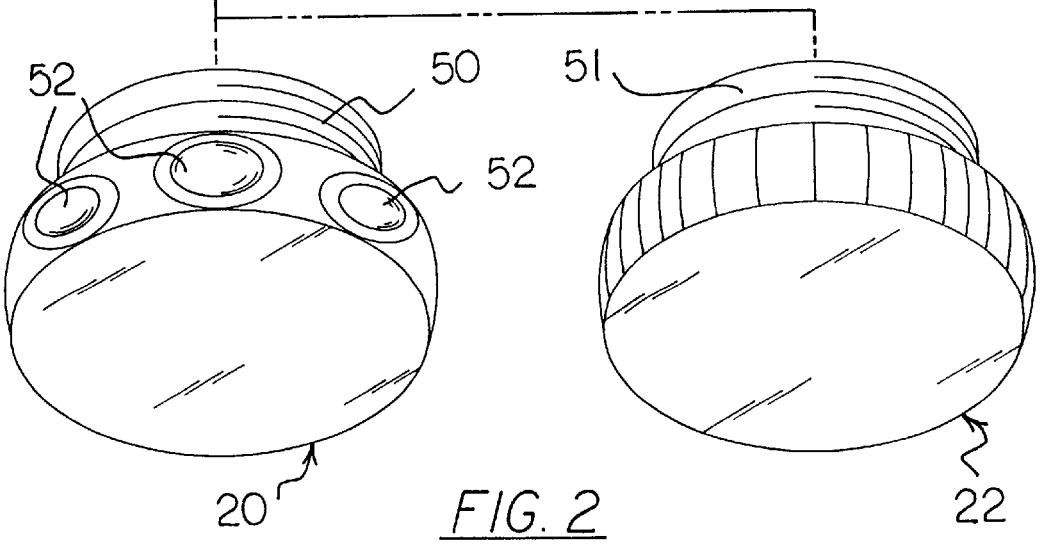
FIG. 2 is a perspective view of the medium earring module with two associated bases.

A long core module 16 is formed in a generally cylindrical configuration having an axis, a closed top and an open bottom 40. A ring 42 is affixed to the center point of the closed top. The diameter of the long core module is essentially the same as the short core module. The open bottom includes a plurality of female screw threads. These modules particularly suited for use with daring wardrobe styles and women with long hair. Note FIG. 2.

Figure 3:
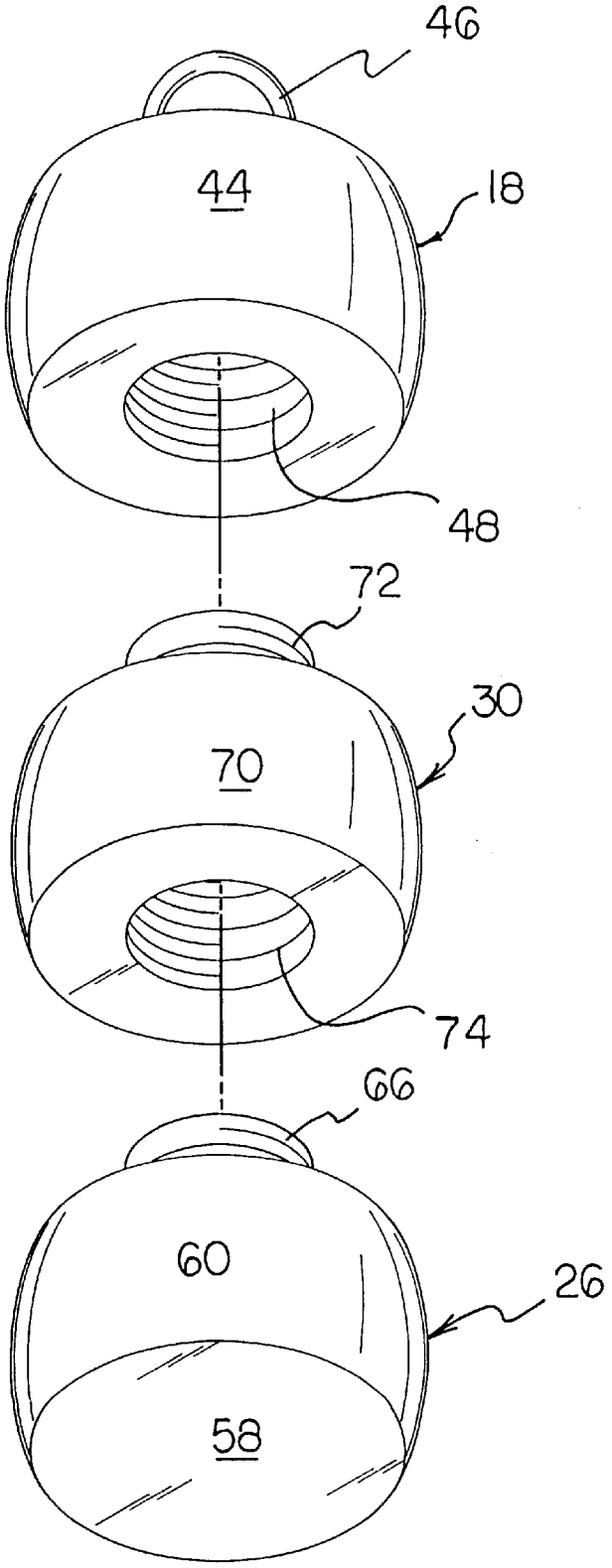
FIG. 3 is a perspective view of the rounded earring module with a coupler an adapter and a base.

A rounded core module 18 is formed in a generally cylindrical configuration having an axis, a closed top, a bottom and a rounded sidewall 44. The rounded core module has a length approximately equal to the length of the short core module. A ring 46 is affixed to the center point of the closed top. The bottom includes a bore 48 with a plurality of female screw threads. Note FIG. 3.

First 20 and second 22 large base modules are included with the apparatus. Each base module is formed in a generally disc shaped configuration with a top, a flat bottom and a sidewall. Each top includes a cylindrical projection member 50, 51 with male screw threads. The first base module 20 has a sidewall which includes a plurality of jewels 52 affixed around it. Each large base module is threadedly couplable to the long core module 16. In varying embodiments different types of jewels can be utilized. Note FIG. 2.

A first small base module 24 includes a planar circular plate 54 with a top and a bottom. The bottom has a semispherical bore 55 extending within it. A large spherical jewel 56 is affixed within the semispherical bore of the plate. A second small base module 26 is formed in a generally cylindrical configuration with a top, a flat bottom 58 and a rounded sidewall 60. A third small base module 28 is formed in an elongated generally cylindrical configuration with a top, a rounded bottom 62 and a sidewall. Note FIGS. 3 and 4.

The top of each small base module includes a cylindrical projection member 64, 66, 68 with male screw threads extending from it. Each small base module is threadedly couplable to the short, medium and rounded core modules. This configuration allows a user to mix and match modules to complement her decor. Note FIGS. 3–5.

An adapter module 30 is formed in a generally cylindrical configuration with bottom, a rounded sidewall 70 and a top which includes a cylindrical projection member 72 which has male screw threads positioned around it. The bottom includes a bore 74 with a plurality of female screw threads positioned within it. In an operative orientation the adapter module threadedly couples a core module to a base module. This allows a user to increase the effective length of a core and base set. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved modular earring assembly adapted for use in association with a user's ear having an open clip positioned therethrough, the apparatus comprising, in combination:

a short core module formed in a generally cylindrical configuration with an axis, a closed top and a bottom, a ring being affixed to the center point of the closed top, the bottom including a bore with a plurality of female screw threads positioned therein;

a medium core module formed in a generally cylindrical configuration with an axis, a closed top and a bottom, a ring being affixed to the center point of the closed top of the medium core module, the bottom of the medium core module including a bore with a plurality of female screw threads positioned therein;

a long core module formed in a generally cylindrical configuration with an axis, a closed top and an open bottom, a ring being affixed to the center point of the closed top of the long core module, the open bottom of the long core module including a bore with a plurality of female screw threads positioned therein;

a rounded core module formed in a generally cylindrical configuration with an axis, a closed top, a bottom and a rounded sidewall, the rounded core module having a length approximately equal to a length of the short core module, a ring being affixed to the center point of the closed top of the rounded core module, the bottom of the rounded core module including a bore with a plurality of female screw threads positioned therein;

first and second large base modules, each base module being formed in a generally disc shaped configuration with a top, a flat bottom and a sidewall, the top of the base modules including a cylindrical projection member including male screw threads positioned therearound, the first base module having a sidewall including a plurality of jewels affixed therearound, each large base module being threadably couplable to the long core module;

a first small base module including a planar circular plate having a top and a bottom, the bottom of the first small base module having a semispherical bore extending therein, a spherical jewel being affixed within the semispherical bore of the plate, a second small base module being formed in a generally cylindrical configuration with a top, a flat bottom and a rounded sidewall, a third small base module being formed in an elongated generally cylindrical configuration with a top, a rounded bottom and a sidewall, the top of each small base module including a cylindrical projection member with male screw threads extending therefrom, each small base module being threadably couplable to the short, medium and rounded core modules; and an adapter module being formed in a generally cylindrical configuration with a bottom, a rounded sidewall and a top including a cylindrical projection member having male screw threads positioned therearound, the bottom of the adapter module including a bore with a plurality of female screw threads positioned therein, in an operative orientation the adapter module threadedly coupling a core module to a base module.

2. A modular earring assembly comprising:

a first core module having a top and a bottom, a ring being affixed to the top, the bottom including a bore having coupling means;

a first base module having a top and a bottom, the top of the first base module including a cylindrical projection member having coupling means, the first base module being couplable to the first core module;

wherein the core and base modules are cylindrical in shape, the bottom of the base module including a spherical jewel affixed thereto;

a second core module formed in a cylindrical configuration with an axis, a closed top, and an open bottom, a ring being affixed to the closed top of the second core module, the open bottom including coupling means; and second and third base modules, each of the second and third base modules being formed in a generally disc shaped configuration with a top, a flat bottom and a sidewall, the top of the second and third base modules including a cylindrical projection member with coupling means positioned therearound, the second base module having a sidewall including a plurality of jewels affixed therearound, the second and third base modules being couplable to the second core module.

3. The modular earring assembly as set forth in claim 2 and further including:

a third core module formed in a rounded cylindrical configuration with an axis, a closed top, a bottom and a rounded sidewall, the third core module having a length approximately equal to a length of the first core module, a ring being affixed to the center point of the closed top of the third core module, the bottom of the third core module including a bore coupling means;

a fourth base module being formed in a generally cylindrical configuration with a top, a flat bottom and a rounded sidewall, the top of the fourth base module having an extension member with coupling means; and an adapter module being formed in a generally cylindrical configuration with a bottom, a rounded sidewall and a top including a cylindrical projection member with coupling means, the bottom of the adapter module including a bore with coupling means, in an operative orientation the adapter module coupling the third core module to the fourth base module.

4. The modular earring assembly as set forth in claim 3 and further including:

a fourth core module formed in a generally cylindrical configuration with an axis, a closed top and a bottom, a ring being affixed to the center point of the closed top of the fourth core module, the bottom of the fourth core module having a bore including a plurality of female screw threads positioned therein; and a fifth small base module being formed in an elongated generally cylindrical configuration with a top, a rounded bottom and a sidewall, the top of the fifth small base module having an extension member with coupling means, the fifth small base module being coupled to the fourth core module in an operative orientation.

* * * * *